US005303653A

United States Patent [19]

Sullivan et al.

[11] Patent Number: 5,303,653

[45] Date of Patent: Apr. 19, 1994

[54] HIGH EXPLOSIVE DISSEMINATOR FOR A HIGH EXPLOSIVE AIR BOMB

[75] Inventors: John D. Sullivan, Edgewood; Charles N. Kingery, Aberdeen, both of Md.

[73] Assignee: The United States of America as represented by the Secretary of the Army, Washington, D.C.

[21] Appl. No.: 917,757

[22] Filed: Sep. 29, 1986

Related U.S. Application Data

[63] Continuation of Ser. No. 573,165, Jan. 23, 1984, abandoned.

[51] Int. Cl.[5] ..... F42B 12/52

[52] U.S. Cl. ..... 102/363; 102/334

[58] Field of Search ..... 102/363, 364, 367, 369, 102/370, 334

[56] References Cited

U.S. PATENT DOCUMENTS

| | | | |
|---|---|---|---|
| 3,320,881 | 5/1967 | Brett et al. | 102/367 X |
| 3,399,468 | 9/1968 | Gäble | 102/367 X |
| 3,570,401 | 3/1971 | Euker | 102/363 |
| 3,730,093 | 5/1973 | Cummings | 102/363 |
| 4,273,048 | 6/1981 | Hey et al. | 102/363 |
| 4,297,949 | 11/1981 | Glass et al. | 102/363 X |
| 4,463,680 | 8/1984 | Seyles | 102/363 |

*Primary Examiner*—David H. Brown

*Attorney, Agent, or Firm*—Thomas McDonald; Saul Elbaum

[57] ABSTRACT

A process and apparatus which can be packaged in a warhead for disseminating a finely divided high explosive by means of a burster charge into the atmosphere as an high explosive dust-air cloud bomb. By interposing a damping means between the explosive burster charge and the load of particulate high explosive, the explosion of the HE explosive inside the container by the burster charge is prevented.

14 Claims, 1 Drawing Sheet

EXPLOSIVE DISSEMINATOR

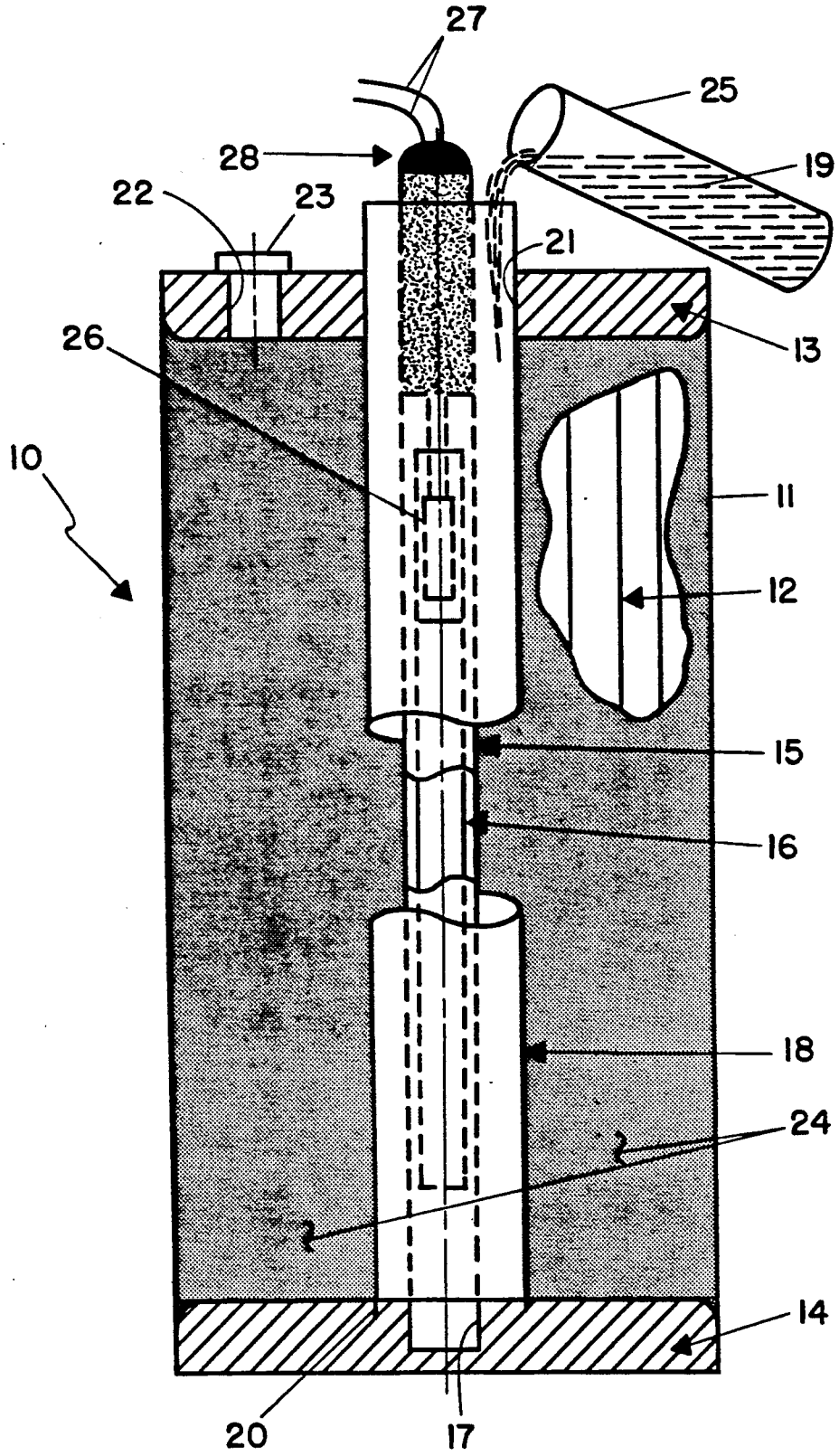
FIGURE (U). EXPLOSIVE DISSEMINATOR

HIGH EXPLOSIVE DISSEMINATOR FOR A HIGH EXPLOSIVE AIR BOMB

GOVERNMENTAL INTEREST

The invention described herein may be manufactured, used and licensed by or for the Government for governmental purposes without payment to us of any royalties thereon.

This application is a continuation of application Ser. No. 573,165, filed Jan. 23, 1984 now abandoned.

BACKGROUND OF THE INVENTION

This invention relates to a novel process and apparatus for explosively dispersing particles of high explosives into the atmosphere to form a high explosive-air bomb.

Devices for explosively dispersing non-explosive substances into the atmosphere, such as pesticides, anti-personnel agents, etc., are well known. Such devices usually contain a tubular burster charge positioned on the axis of a cylindrical container and surrounded by the powdered substance to be dispersed, which on firing of the burster charge is forced outwardly to rupture the thin container walls and is dispersed into the atmosphere. A similar arrangement is also employed in liquid fuel filled munitions for dispersing the fuel, e.g., propylene oxide, into the atmosphere as an aerosol cloud of fine liquid droplets to produce a fuel-air explosive (FAE) bomb, which is detonated by a second, delayed initiator in known manner. If a similar arrangement is attempted for dispersing a particulate high explosive (HE), e.g., RDX (1,3,5-trinitro-1,3,5-triazocyclohexane), the high explosive will explode inside the container rather than being dispersed into the atmosphere to form an aerosol bomb. The basic reason for the failure is that the particulate high explosive charge is detonated by the severe conditions resulting from the explosion of the central burster charge required for dispersing the particulate high explosive.

A high explosive dust-air bomb would be advantageous as compared to a conventional liquid fuel-air explosive (FAE) bomb, due to the much higher energy output of the high explosive. There are no known devices which employ the technique of explosive dissemination for the dispersal of HE dust. At present HE dust must be dispersed into the atmosphere by spraying or impulsively loading a holder having a thin layer of HE material. These techniques cannot be readily packaged into a warhead.

SUMMARY OF THE INVENTION

In accordance with the present invention, there is provided a novel apparatus, which can be packaged in a warhead, such as a projectile, for disseminating a finely divided high explosive (HE) by means of a burster charge into the atmosphere as an HE dust-air cloud bomb, which can be detonated by a conventional delay detonator.

We have found that the explosion of the HE explosive load inside the container by the burster charge can be prevented and that dissemination of the particulate high explosive into the atmosphere to form a HE-air cloud bomb can be achieved by interposing a damping means between the explosive burster charge and the load of particulate high explosive.

More particularly, this invention provides a novel device for disseminating a particulate high explosive into the atmosphere to produce an HE-air aerosol bomb, which comprises:

- a cylindrical container;
- a linear burster charge disposed along the longitudinal axis of said cylindrical container;
- a particulate high explosive charge disposed in said container and surrounding said burster charge; and
- a damping means for preventing the detonation of said high explosive charge inside said container when said burster charge is exploded, said damping means consisting essentially of a liquid or solid material and being disposed between said linear burster charge and said high explosive charge.

BRIEF DESCRIPTION OF THE DRAWING

The drawing illustrates a longitudinal sectional view of an explosive disseminator of the present invention.

DETAILED DESCRIPTION OF THE INVENTION

With reference to the drawing, the explosive disseminator 10 includes a cylindrical tubular casing 11 of suitable material, such as cardboard, nylon or copper weakened with scores 12, provided with relatively thick top and bottom end plates 13 and 14, respectively, of suitable material, such as plywood or preferably brass. Disposed along the longitudinal axis of the disseminator is a copper burster tube 15 containing a burster charge 16. The lower end of the burster tube 15 is adhesively held in a central bore 17 of the bottom plate 14. Surrounding the burster tube 15 is a copper damper tube 18 filled with a damping liquid 19. The damper tube 18 lower end is adhesively held in an annular groove 20 in the bottom plate 14. The top end plate 13 has a central hole 21 for receiving and holding the damper tube 18, and contains an opening 22 with closure plug 23 for introducing the particulate HE 24. Alternatively and preferably, the HE can be charged prior to affixing the top plate to the casing. The top and bottom end plates may be affixed to the casing with adhesive, e.g., epoxy resin, or in other suitable manner. Metal tubes are preferably employed since they serve to drain off any static electric charge.

The explosive disseminator munition was assembled as follows:

The burster tube 15, the damper tube 18 and the tubular casing 11 were mounted to the bottom end plate 14. The HE powder 24 was then loaded into the annular volume between the casing 11 and the damper tube 18, after which the top end plate 13 was attached to the casing. The loaded munition was moved to the test site and the damping liquid or buffer 19 was poured from a container 25 into the annular volume between the burster tube 15 and the damper tube 18. The burster charge 16, which was provided with a blasting cap detonator 26 attached to blasting wires 27, was inserted into the burster tube 15 and the tube was then sealed with a sealant 28.

The disseminator was tested as follows:

A delay detonator charge for detonating the HE-air cloud was placed on the ground at a selected distance from the disseminator 10, which was also placed on the ground, to insure that it was located within the HE-air cloud produced. Blast gages were emplaced flush with the ground to record the peak overpressure produced.

The burster charge (Primacord) was detonated, causing the liquid buffer to be pushed outward, which in turn projected the HE powder outward into the atmosphere to produce a large pancake-like HE-air cloud. The delay detonator was fired electrically from a sequence timer at a predetermined time when the cloud covered the delay detonator charge, thereby detonating the HE cloud. When the novel explosive disseminator is employed in a munition such as a projectile, a fuzed delay detonator charge for detonating the HE-air cloud produced and ejector therefor is packaged within the disseminator, as is conventionally provided in munitions for producing liquid fuel-air aerosol bombs.

The use of heavy end plates 13 and 14 in combination with a weak casing 11 suppresses the HE-air cloud thickness and produces a large pancake-like HE-air cloud. However, the present invention is not limited to this preferred design or configuration.

The following example illustrates a specific disseminator device successfully tested according to the present invention:

| Item No. | Item (Dimensions in inches) |
|---|---|
| 11 | Cardboard mailing tube, spiral wound, 6.0 ID, ⅛ wall, 12¾ height, Volume 1.2 gal |
| 14 | End-plate, bottom, 6.0 dia brass round stock, ¾ thick. Drilled ⅛ deep central bore 17 to accommodate item 15 and with annular groove ⅛ deep. 1.568 dia, 1/16 wide 20 to accommodate item 18. |
| 18 | Damper tube, copper Type M, 1.625 OD, 0.049 wall, height 13⅛. Holds fluid, item 19. Volume 0.09 gal. |
| 15 | Burster tube, copper Type M, 0.625 OD, 0.035 wall, height 13¾. Holds cord, item 16. |
| 24 | Powdered high explosive, 50/50 Pentolite, 3400 grams. |
| 13 | End-plate, top, 6.0 dia brass round stock, ¾ thick. Drilled centrally 1.633 (21) to pass item 18. Closes cardboard tube 11 after desired weight of powdered high explosive put inside item 11. Fill plug 23 (1 dia) for powdered high explosive not used in Test. |
| 16 | Burster charge, detonating cord Primacord manufactured by Ensign-Bickford Co., Simsbury, Conn. with US Engineer's Special blasting cap item 26 (L = 2¼, dia = ¼) butted and taped. 100 grain/ft coreload and 7 inch length, ¼ dia. cord approximately centerd in item 11 by blasting wires 27 in item 28. Total charge length 9¼. |
| 28 | Inert putty-like sealant, Duxseal, Manville Corp., closes off item 15. |
| 19 | Damping liquid, detonable in air: normal propyl nitrate, filling item 18 and attenuating shock of cord item 16. |

The novel and essential features of the present invention include the use of a damper tube which encloses or surrounds the central burster tube and is filled with a damping liquid or a damping solid, such as an organic plastic material, e.g., Lucite, in combination with a drastically lower amount and linear density of burster charge than is employed with non-explosive fills.

The present invention provides an important advance in the art, since it permits the production of HE-air clouds, which when exploded yield a higher peak overpressure (energy) than can be obtained from a conventional fuel-air explosive (FAE) bomb.

The damping material employed in the present invention is preferably a combustible liquid, that is, one that burns in air. Combustible liquids which can be employed in conventional fuel-air explosive bombs are particularly suitable, since they contribute a minor amount of energy to the HE-air blast. Suitable combustible liquids include hydrocarbons, such as pentanes, gasoline and kerosene, and hydrocarbon derivatives, such as, for example, nitromethane, n-propyl nitrate and propylene oxide. Non-combustible liquids, such as water and liquid nitrogen, also can be used as suitable damping liquids. However, when the damper tube is filled with a gas, e.g., air, instead of a liquid or solid damping material, the HE will detonate within the container when the burster charge is exploded.

Solid materials can also be employed as the damping material. The solid material employed as damper material, like the liquid damper material, must be present in sufficient thickness radially between the burster tube and particulate HE charge in the container to attentuate the shock wave from the burster charge before it reaches the surrounding HE charge so as to prevent detonation thereof within the container and yet permit dispersion of the HE particles into the atmosphere. Organic natural and synthetic plastics in bead form, e.g., polyethylene, polyamides and polyacrylates, especially Lucite , a polymerized methyl methacrylate resin, as well as microscopic glass beads can be employed as damping materials. The organic plastic material can also be effectively employed as the damping material in the form of a hollow tube of suitable wall thickness, which is surrounded by the HE charge and contains the burster charge disposed in the central longitudinal hollow thereof. Such a hollow organic plastic damper tube may be more convenient to employ than a hollow thin walled metal tube of similar diameter containing a liquid damping material. Damper tubes of electrically conductive organic plastic material can be advantageously employed, since they permit any static charge on the device to be drained off.

The amount of burster charge employed in the device of the present invention to disseminate the HE into the atmosphere is generally much less than that ordinarily used in conventional explosive disseminators for dispersing liquids and powdered solids into the atmosphere, e.g., chemical agents, pesticides, fuels for fuel-air bombs, etc. The burster charge employed is sufficient to readily rupture the disseminator casing and damper and burster tubes; and the amount and type thereof utilized in the disseminator can be varied widely due to the presence of the damping liquid/solid, which acts as a powerful buffer to prevent detonation by the exploded burster charge of the HE within the container.

The HE charge in the disseminator device is in the form of finely divided solid particles, preferably of average particle size less than about 100 microns, particularly less than about 1000 microns. Such fine particles of HE when dispersed as a cloud into the atmosphere are more readily detonated by the delayed initiator than are larger particles. Suitable solid high explosives include TNT (2,4,6-trinitrotoluene), RDX (1,3,5-trinitro-1,3,5-triazocyclohexane), HMX (1,3,5,7-tetranitro-1,3,5,7-triazocycloactane), PETN (pentaerythritol tetranitrate) nitro-guanidine, and mixtures thereof.

What is claimed is:

1. In an apparatus for disseminating a particulate high explosive (HE) into the atmosphere to produce an HE-air cloud, which comprises:

a container;

a particulate high explosive charge disposed in said container; and a burster charge for disseminating said particulate high explosive into the atmosphere, said burster charge being surrounded by said high explosive charge;

the improvement which comprises a means for damping said burster charge to prevent the detonation of said high explosive charge inside said container, said damping means comprising a liquid or solid material being disposed between said burster charge and said high explosive charge.

2. An apparatus according to claim 1, wherein the damping liquid comprises a combustible liquid.

3. An apparatus according to claim 1, wherein the damping means comprises an organic plastic.

4. An apparatus according to claim 3, wherein the organic plastic is polymethyl methacrylate.

5. In an apparatus for disseminating a particulate high explosive (HE) into the atmosphere to form a high explosive-air cloud, which comprises:

a cylindrical container;

a linear burster charge disposed along the longitudinal axis of said cylindrical container; and a particulate high explosive charge disposed in said container and surrounding said linear burster charge;

the improvement which comprises a means -for damping said burster charge to prevent the detonation of said high explosive charge inside said container, said damping means comprising a liquid or solid material surrounding said linear burster charge and being disposed between said burster charge and said high explosive charge.

6. An apparatus according to claim 5, wherein the damping means comprises a combustible liquid.

7. An apparatus according to claim 5, wherein the damping means comprises an organic plastic.

8. An apparatus according to claim 7, wherein the organic plastic is in the form of a hollow tube containing said linear burster charge disposed in the hollow center thereof.

9. An apparatus according to claim 8, wherein the organic plastic is polymethyl methacrylate.

10. An apparatus for disseminating a particulate high explosive (HE) into the atmosphere to form a high explosive-air cloud, which comprises:

a cylindrical casing including a sidewall and top and bottom end closure plates affixed thereto;

an inner cylindrical tube disposed along the longitudinal axis of said casing;

an intermediate cylindrical tube disposed around said inner cylindrical tube, said tubes and casing being concentric with each other;

a linear burster charge disposed in said inner tube;

a high explosive charge disposed in the annular space between said intermediate tube and said casing;

a damping means for preventing the detonation of said high explosive charge inside said casing when said burster charge is exploded, said damping means comprising a liquid or solid material and being disposed in the annular space between said inner tube and said intermediate tube.

11. An apparatus according to claim 10, wherein the damping means comprises a combustible liquid.

12. An apparatus according to claim 10, wherein said casing end plates are stronger than said casing sidewall so that on explosion of the burster charge, the casing sidewall is preferentially ruptured and said high explosive charge is expelled essentially radially from said cylindrical casing into the atmosphere to form a pancake-shaped HE-air cloud.

13. An apparatus according to claim 12, wherein at least one of said end plates is metallic and at least one of said cylindrical casing and tubes is metallic and is connected to at least one of said metallic end plates to aid discharge of static electricity.

14. A method for disseminating a particulate high explosive (HE) into the atmosphere to produce an HE-air cloud, which comprises disposing a particulate high explosive charge around a burster charge for disseminating said high explosive into the atmosphere, and interposing between said high explosive charge and said burster charge a means for damping said burster charge to prevent the detonation of said high explosive charge by said burster charge.

* * * * *